United States Patent [19]

Sartain

[11] Patent Number: 4,469,195

[45] Date of Patent: Sep. 4, 1984

[54] LADDER SAFETY ATTACHMENT

[76] Inventor: Don M. Sartain, P.O. Box 314, Wabasso, Fla. 32970

[21] Appl. No.: 490,130

[22] Filed: Apr. 29, 1983

[51] Int. Cl.[3] ..... E06C 7/48

[52] U.S. Cl. ..... 182/206; 182/107; 182/214

[58] Field of Search ..... 182/206, 93, 214, 107, 182/108

[56] References Cited

U.S. PATENT DOCUMENTS

| | | | |
|---|---|---|---|
| 1,658,191 | 2/1928 | Gravning | 182/206 |
| 1,961,289 | 6/1934 | Gardner | 182/206 |
| 2,232,414 | 2/1941 | Swann | 182/206 |
| 3,028,929 | 4/1962 | Chubbs | 182/206 |
| 3,037,579 | 6/1962 | Barrow | 182/107 |
| 3,336,999 | 8/1967 | McSwain | 182/206 |

FOREIGN PATENT DOCUMENTS

| | | | |
|---|---|---|---|
| 1118135 | 3/1956 | France | 182/93 |

*Primary Examiner*—Reinaldo P. Machado
*Attorney, Agent, or Firm*—Paul H. Gallagher

[57] ABSTRACT

The safety attachment includes a flat strap base member and a clamp thereon to detachably mount it on the top rung of a ladder. A pair of curved horns are pivoted on the ends of the base member, the horns being curved to fit around the tree against which the ladder is put, and with teeth on their concave sides to bite into the tree. The horns have diverging extensions at their outer or swinging ends which act as camming elements in applying the attachment to the tree. A chain interconnects the horns, which rests against the tree, and a tension spring also interconnects the horns. The horns have inner extensions extending oppositely beyond the pivot axes, and a pull rope interconnects these extensions and reaches the ground, which the user can pull for swinging the horns away from each other and releasing them from the tree.

5 Claims, 4 Drawing Figures

LADDER SAFETY ATTACHMENT

OBJECTS OF THE INVENTION

A broad object is to provide an attachment for a ladder operable for engaging the object against which the ladder is placed, such as a tree or a pole, for preventing the ladder from slipping therefrom and falling, and particularly such that has the following features and advantages:

1. It is very simple and can be easily applied to an ordinary ladder.

2. It can be manually manipulated by the user on the ground when the ladder is upright and near its placement position.

3. It has special construction and shape whereby it effectively grips the object against which it is placed, and resists sliding movement relative thereto, such as occurs in the case of a narrow object such as a tree or a pole.

4. The weight of the ladder against the object tends to produce a greater gripping action.

DESCRIPTION OF A PREFERRED EMBODIMENT

Referring in detail to the drawings, a ladder is indicated at 10, having a plurality of rungs 12, set up against an object 14 which may be a tree, a pole, etc. Ordinarily when the ladder is applied to a tree, the top rung 12 bears directly thereon. For convenience, the term tree will be used herein as a generic term for all objects 14.

Figure 1:
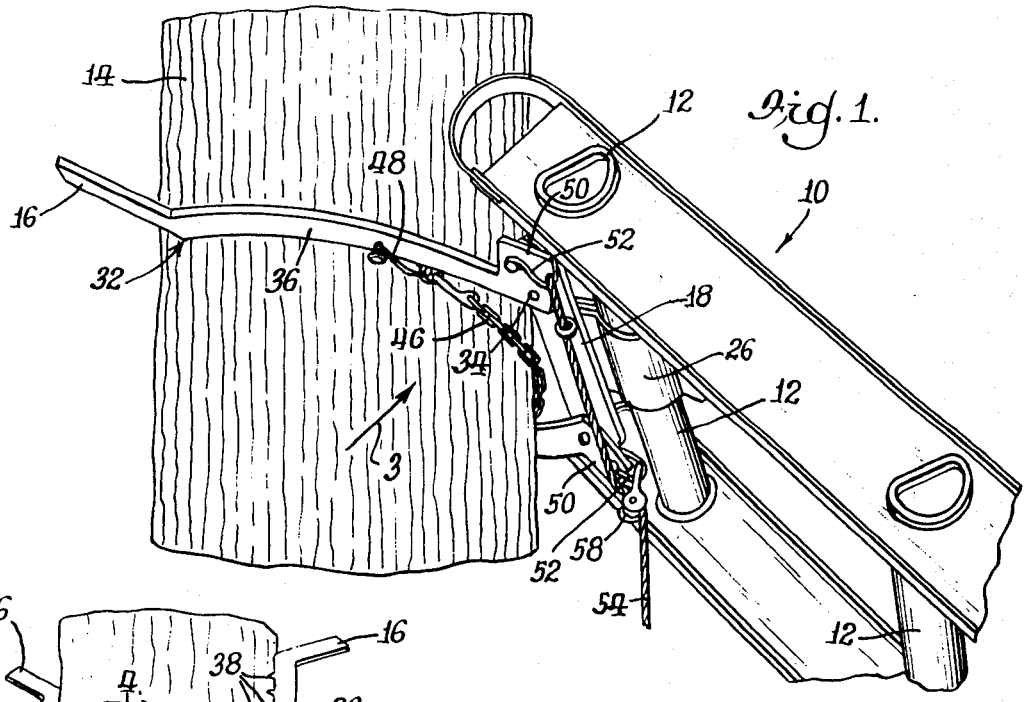
FIG. 1 is a perspective view of the upper end of a ladder on which the safety attachment is mounted, and a portion of a tree to which the ladder is applied.
Figure 2:
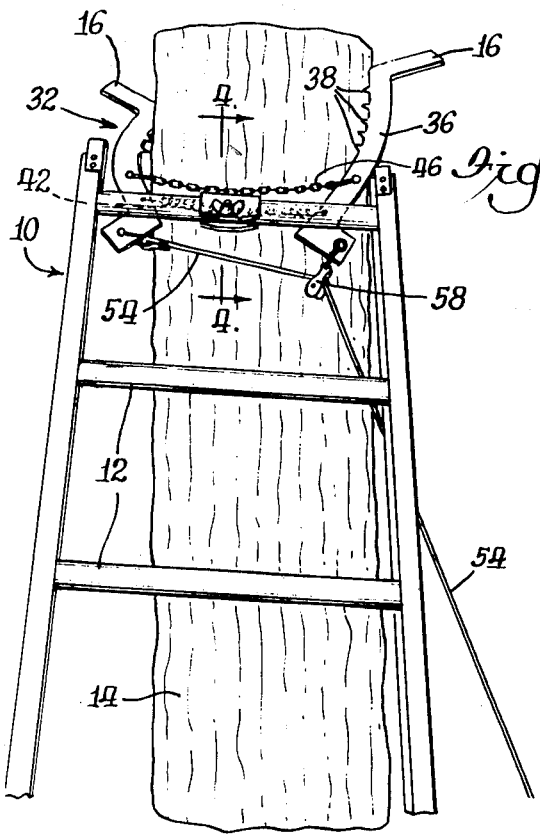
FIG. 2 is a perspective view taken from the right of FIG. 1.

The safety attachment of the invention is indicated in its entirety at 16, and is shown in FIGS. 1 and 2 as applied to the ladder. Specifically it is mounted directly on the top rung 12 of the ladder in a manner described hereinbelow. The following description however is directed first to the specific construction thereof, which is at least partially shown in all the figures, but best shown in FIG. 3. It includes a base member 18 which is preferably a straight flat strap. Secured to the base member 18 is a clamp 20 which may be a pair of opposed pieces 20*a*, 20*b* having flat portions 22 fitted to the base member 18 on opposite sides thereof and secured thereto by suitable means such as screws or bolts 24. They have bowed portions 26 which surround and grip the rung 12, and terminal flat portions 28 which are secured together by an adjustable means such as bolt and wing nut 30. Preferably the clamp 20 is positioned midway of the length of the base member 18, and normally the clamp would be applied to the rung 12 at the mid portion of the rung, thereby positioning the attachment generally midway of the width of the ladder. The clamp 20 is easily applied to and removed the rung, and the attachment accordingly easily applied to and removed from the ladder. Additionally the attachment may be adjustably positioned angularly relative to the ladder, as will be referred to hereinbelow.

Mounted on the base member 18 are a pair of curved horns 32, pivoted at 34 thereon, and their inwardly directed concave sides or edges are provided with teeth 38 for gripping the tree. At the outer or swinging ends of the horns, are extensions 40 which diverge in outer direction, i.e., away from the base member, serving as camming elements in applying the attachment to the tree as will be referred to again hereinbelow.

Interconnected between the horns 32 is a tension spring 42, secured as by clevises 44, the spring serving to yieldingly bias the horns inwardly toward each other. Also interconnecting the horns is a chain 46, secured as by clevises 48, at points 49 on the horns. As will be observed from the various figures, the spring 42 is nearer the base member 18 while the chain 46 is positioned outwardly thereof, i.e., toward the outer swinging ends of the horns. This arrangement is provided so that the chain, rather than the spring, will receive the thrust directly from the ladder, when the ladder is put against the tree.

For manually manipulating the horns for releasing them from the tree when the ladder is to be lowered, the horns 32 are provided with diverging extensions 50 extending from their inner ends, and mounted on the extensions 50 are clevises 52, and a pull rope 54 has one end 56 suitably secured to one of the clevises, and is threaded through a pulley 58 secured to the other clevis and drops to the lower end of the ladder where the user may grasp it.

In applying the ladder to the tree, the user raises it in the usual manner and puts the upper end thereof against the tree. The attachment 32 is normally at a position somewhat transverse to the plane of the ladder, although usually at an acute angle relative thereto. In moving the upper end of the ladder against the tree, the user may force the ladder and utilize the extensions 40 as camming elements which, in engaging the tree, cam the horns outwardly, and then the horns move into position around the tree. Alternatively, he may grasp the pull rope 54 and draw on it to manually spread the horns, and move the ladder into position, with the horns free of the tree, and then release the horns, and the horns then move inwardly against the tree. The tension spring 42 constantly biases the horns inwardly, but an advantageous feature of the invention is that as the ladder moves against the tree, the chain 46 engages the tree and receives the major portion of the thrust or weight of the ladder against the tree. This action pulls the horns inwardly toward each other, i.e., the center portion of the chain moves, relatively speaking, rearwardly or toward the base member 18, and this action effectively shortens the chain, i.e., it shortens the distance between the points 49, which results in drawing the horns inwardly. The spring 42 is positioned whereby it may also engage the tree as the ladder is applied thereto, and while it would of course follow the curvature of the tree it does not receive the major portion of the thrust as between the ladder and the tree.

Figure 4:
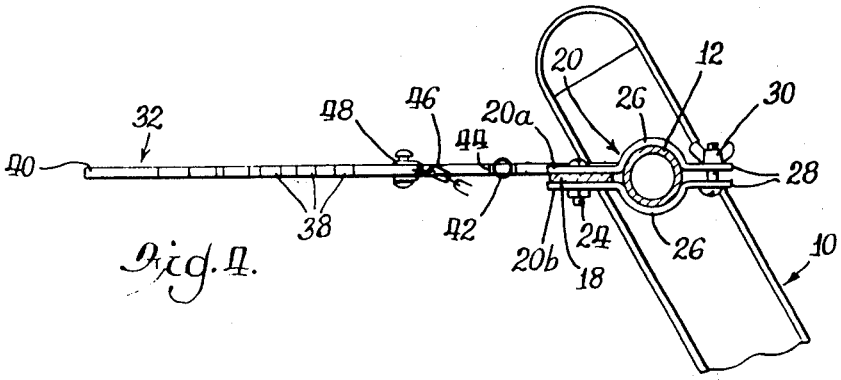
FIG. 4 is a sectional view taken at line 4—4 of FIG. 2.

As indicated above, the clamp 20 is adjustable, and it can be easily and readily positioned in any angular position within a wide range, as indicated by the dot-dash lines 32*a*, 32*b* in FIG. 4, representing the center line of the horns 32. If it is desired that the ladder be in a steep position, the attachment would simply be put in a lower position, while on the other hand if it is to assume a relatively flat slope, the attachment may be adjusted to the upper position indicated. This angular positioning can be accomplished by merely loosening the wing nut on the assembly 28, 30 and again tightening it, and it is within the scope of the invention that such angular adjustment be accomplished while the user is actually on the ladder.

Figure 3:
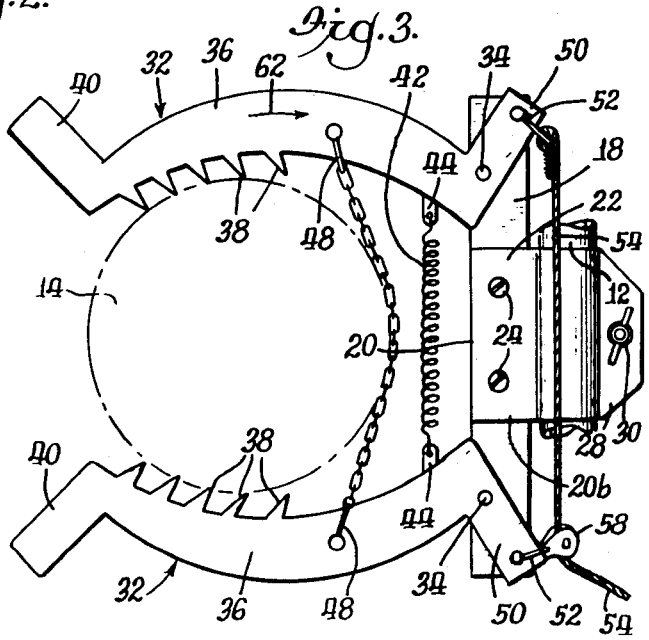
FIG. 3 is a plan view of the safety attachment, oriented according to the arrow 3 of FIG. 1.

An important feature of the invention is the built-in or innate action of the horns in establishing a safety condition. Referring to FIG. 3, assume that there is a tendency for the ladder to shift toward the reader indicated by the arrow 60, which would be to the left viewed in FIG. 2. Any movement in this direction, would tend to move the horns in that direction also, and considering the horn at the top of FIG. 3 it could not of course move bodily against the tree, and the action of the ladder would tend to move it circumferentially in the direction of the arrow 62, but the teeth are inclined in such direction that that circumferential movement would cause the teeth to penetrate directly into the tree, in a direction actually very close to the center lines of the teeth themselves. Thus a very effective gripping action is provided, with corresponding assurance of the attachment not being pulled off the tree. A similar but opposite action would of course take place on the opposite side of the attachment.

When the ladder is to be lowered, the user merely pulls on the pull rope 54 which spreads the horns and releases them from the tree, and then lowers the ladder.

Although the foregoing presumes the teeth 38 actually penetrating a tree, such penetration is a matter of degree, and they would penetrate or firmly grip a pole, or even a metallic object if the latter had a rough surface, the teeth effectively gripping a rough surface without actually penetrating into the interior thereof.

The safety attachment is extremely simple, being made up of simple parts and the fabrication thereof involves simple and inexpensive manufacturing steps.

Another advantage is that the attachment can be easily applied to any ladder, without prior modification or adaptation of the ladder. It is also feasible and convenient to have attachments of various sizes, for use with ladders of different sizes and for use with trees of different sizes.

I claim:

1. A ladder safety attachment comprising, a base member, means on the base member operable for detachably securing the attachment to the ladder, a pair of horns pivoted on the base member at widely spaced points on the latter and swingable thereon toward each other for gripping an object therebetween against which the ladder is placed and away from each other for releasing them from the object, the horns being swingable independently of any connection with the ladder, a spring yieldingly biasing the horns toward each other, a chain interconnecting the horns adjacent the base member, the chain being transversely flexible but non-yieldable linearly outwardly, the chain engaging the object when the horns are in gripping position, and means actuatable by a user on the ground operable for moving the horns away from each other.

2. A ladder safety attachment according to claim 1 wherein, the horns are curved with concave surfaces directed toward each other for at least partially surrounding the object and are provided with teeth on their concave surfaces directed diagonally in direction generally toward the base member for biting into the object.

3. A ladder safety attachment according to claim 2 wherein, the horns have outer extensions at their swinging ends diverging in direction away from the base member operable, in response to the horns engaging the object, for camming the horns outwardly away from each other, to assist the horns moving into position surrounding the object.

4. A ladder safety attachment according to claim 1 wherein, the securing means includes a clamp capable of securement to a straight rung of the ladder.

5. A ladder safety attachment according to claim 1 wherein, the actuatable means includes inner extensions on the horns extending beyond the pivot axes, and a pull rope reaching to the ground and connected with said inner extensions and thereby operable in response to pulling of it for drawing the extensions toward each other and thereby swinging the horns away from each other.

* * * * *